United States Patent [19]

Smith

[11] Patent Number: 4,637,191

[45] Date of Patent: Jan. 20, 1987

[54] STARTER SHINGLE

[76] Inventor: Robert L. Smith, 303 E. Bridge St., Blackwell, Okla. 74631

[21] Appl. No.: 677,586

[22] Filed: Dec. 3, 1984

[51] Int. Cl.[4] ..... E04D 1/00

[52] U.S. Cl. ..... 52/522; 52/98; 52/523

[58] Field of Search ..... 52/98, 100, 522, 523, 52/533, 105, 518

[56] References Cited

U.S. PATENT DOCUMENTS

| | | | |
|---|---|---|---|
| 1,597,993 | 2/1923 | Meurer | 52/522 X |
| 2,552,159 | 5/1951 | Eason | 52/98 |
| 2,829,607 | 4/1958 | Patterson | 52/523 |
| 3,903,340 | 9/1975 | Shepherd | 52/518 X |
| 4,404,783 | 9/1983 | Freiborg | 52/98 X |

*Primary Examiner*—William F. Pate, III
*Assistant Examiner*—Creighton Smith
*Attorney, Agent, or Firm*—John A. Hamilton

[57] ABSTRACT

A roofing shingle having its lower edge portion vertically slotted to divide it into a series of tabs, the shingle being configurated to permit easy breaking of the tabs from the upper part of the shingle, and having a horizontal strip of heat-sensitive adhesive applied to its upper surface on a line above the upper ends of its slots, the upper portions then being usable to form a course of starter shingles along the eave edge of a roof deck to provide an uninterrupted shingle beneath the slots of a course of standard shingles applied over the starter course, with its adhesive strip positioned to seal down the tabs of the first course of standard shingles, and the separated tabs being usable to simulate a course of topping-out shingles adjacent the ridge of the roof. The top surface of the shingle is also configurated to drain water away from the nails used to secure it in place, to inhibit leakage of water through the nail holes in the shingle.

2 Claims, 9 Drawing Figures

STARTER SHINGLE

Figure 1:
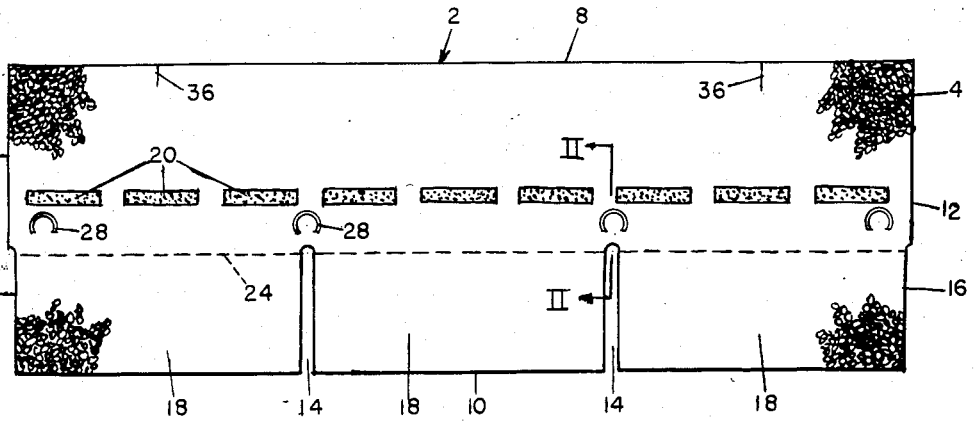

This invention relates to new and useful improvements in roofing shingles, and has particular reference to shingles of the class commonly known as "starter shingles".

Starter shingles are those shingles applied in a first course along the lower or eave edge of a roof deck before the commencement of the application of standard shingles in the usual manner and have the function of preventing leakage of water through the slots of the first course of standard shingles to the roof deck below. The butt portions of standard composition shingles are virtually always slotted inwardly from their lower edges, which are exposed to the weather, at intervals along their horizontal width, in order to provide a decorative appearance to the finished roof. The slots of the shingles of all courses above the first lie above uninterrupted portions of the next lower course of shingles, so that leakage therethrough to the roof deck cannot occur, but the slots of the first course provide direct access for water to the deck. Hence the necessity of a course of starter shingles beneath said first course. The starter shingles must of course be uninterrupted and free of slots.

In present practice, starter shingles are provided by standard shingles, reversed end-for-end from the usual position, so that the slotted butt portions thereof project upwardly of the roof edge, and the unslotted portion projects flush with the eave edge. The slots of the first course of shingles then applied, which are also extended to the eave edge, are then disposed over unslotted portions of the starter shingles, and the leak protection is thus provided.

However, this mode of providing starter shingles is subject to certain disadvantages. It results in a double shingle thickness at the upper edges of the starter shingles and the first course of standard shingles, which are coincident. This double thickness is not required, and is hence wasteful of shingles. Also, this double thickness provides a cavity when the second course of shingles is applied, in which seepage water may collect and stand, and eventually find its way to nail holes and thence to the roof slab. Furthermore, this "dam" cavity is multiplied when more than one set of roofing shingles is applied, as is common as leaks inevitably develop over periods of years.

Generally, insurance regulations presently permit the application of three shingle sets, before the application of a new set requires the removal of one or more of the prior sets. Also, the provision of starter shingles by the end-for-end reversal of standard shingles is particularly disadvantageous when the shingles are of the so called "seal down" type. In this type of shingle, a line of adhesive is applied to the outer surface of each shingle at the time of manufacture, above the upper ends of the butt slots thereof, but in an area thereof which will be overlapped by the butt portion of the next higher course of shingles. The adhesive is of a heat-activated type, so that after the shingles are applied, the heat of the sun will activate the adhesive to seal the butt portion of the shingle to the next lower course of shingles. This protects the shingles against damage from high wind which otherwise could "peel" the shingles from the roof. The butt portions cannot be nailed down, since the nail holes themselves could be an avenue for leakage. If starter shingles are provided by reversing such a standard seal-down shingle, the line of adhesive of the starter shingles cannot be positioned properly to seal down the butt portions of the first course of shingles applied normally thereover. If even this lowermost course of shingles is not sealed down, a very strong wind could peel them back, and possibly peel back several higher courses of shingles.

The provision of a starter shingle overcoming all of the above disadvantages is the object of the present invention. Generally, this object is accomplished by the provision of a standard shingle, normal in all details except that provision is made whereby the butt tabs thereof may be broken free of the remainder of the shingle along a line at or near the closed ends of the slots thereof, and parallel to the lower edge of the shingle. The remaining portion of the shingle may then be used as a starter shingle applied without reversal to the eave edge of a roof deck. Being unslotted, this portion provides leak protection under the slots of the first course of full shingles applied thereover, and being vertically narrower than a full shingle, it avoids the previously described doubling of shingle thickness at the upper edge of the starter shingle course. Furthermore, it positions the adhesive strip of the starter shingles properly to seal down the butt tabs of the first course of full shingles applied thereover, so that the butt tabs of the entire roof, including those of the lowermost course of shingles, are sealed down to prevent wind damage. Also, the broken-off butt tabs may be saved, and later used as topping-out shingles adjacent the ridge of the roof, as will be described. This can provide a substantial saving of shingles which would otherwise necessarily be cut down for use as topping-out shingles. The breaking off of the butt tabs may be facilitated by grooves scored deeply in the back surface of the shingle along the line of breakage.

Another object is the provision of a shingle of the character described having provision for inhibiting the flow of seepage water between the shingles to the shingle holes formed by the nails used to secure the shingles in place. This nail-hole leakage is a constant and frustrating defect of most shingle roofs.

Other objects are extreme simplicity and economy of structure, and efficiency and dependability of operation.

Figure 2:
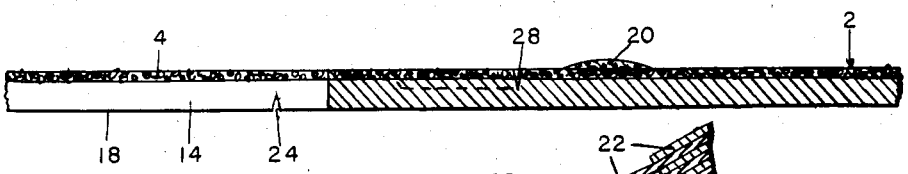
Figure 7:
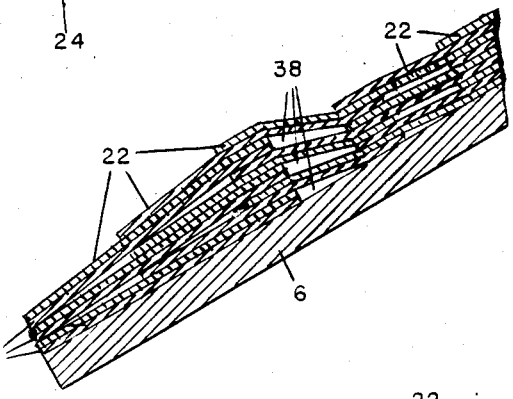
Figure 8:
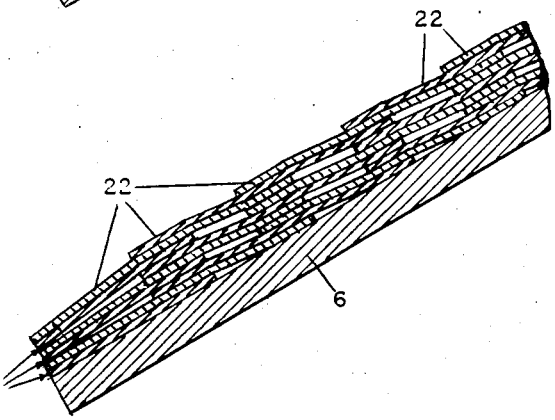
Figure 9:
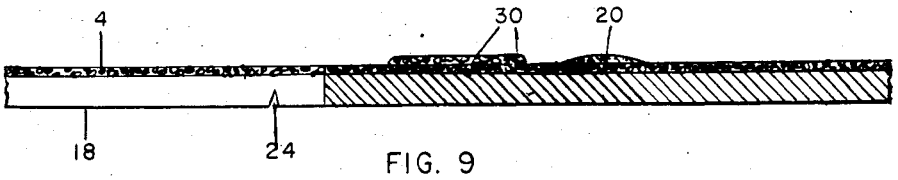
Figure 3:
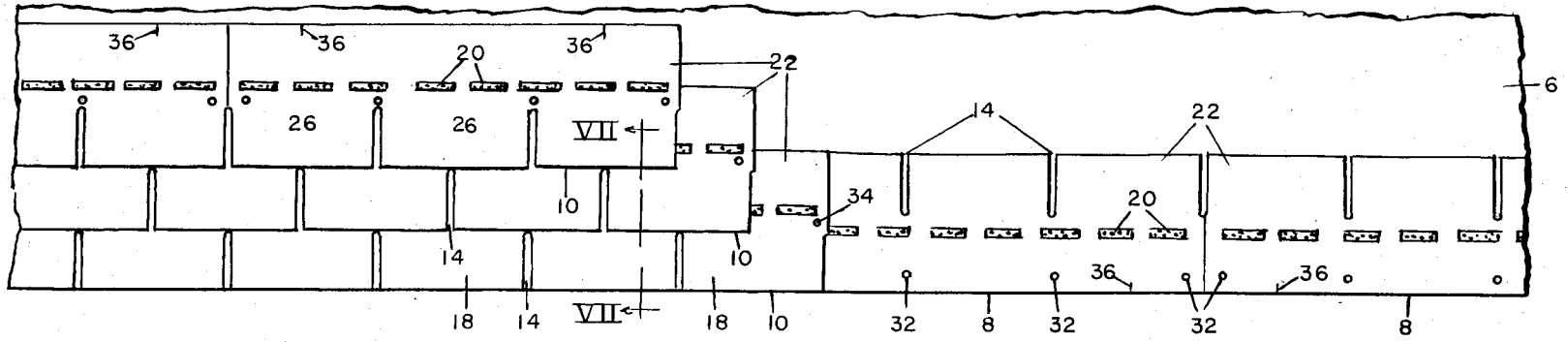
Figure 4:
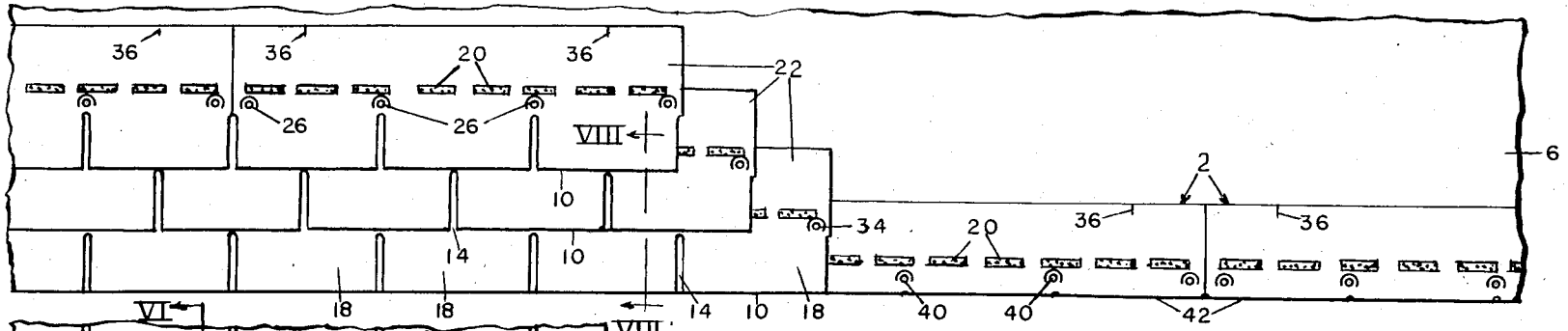
Figure 6:
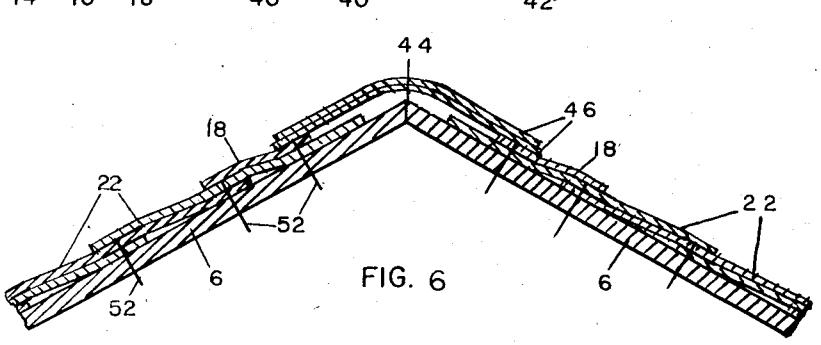
Figure 5:
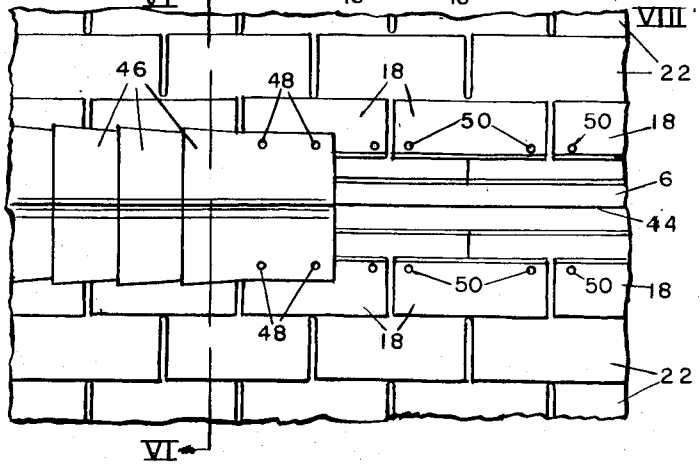

With these objects in view, as well as other objects which will appear in the course of the specification, reference will be had to the accompanying drawing, wherein:

FIG. 1 is a face view of a starter shingle embodying the present invention,

FIG. 2 is an enlarged, fragmentary sectional view taken on line II—II of FIG. 1, FIG. 3 is a fragmentary top plan view of a roof deck, illustrating the process of applying shingles thereto, employing reversed standard shingles as starter shingles, according to present common practice, FIG. 4 is a view similar to FIG. 3, but illustrating the process of applying shingles to the deck, but employing portions of the shingles forming the subject matter of the present invention as starter shingles, FIG. 5 is a fragmentary top plan view of the ridge portion of a roof, illustrating the use of portions of the shingle forming the subject matter of the present invention as topping-out shingles, FIG. 6 is an enlarged, fragmentary sectional view taken on line VI—VI of FIG. 5, FIG. 7 is an enlarged, fragmentary sectional view taken on line VII—VII of FIG. 3, FIG. 8 is an enlarged, fragmentary sectional view taken on line VIII—VIII of FIG. 4, and FIG. 9 is a view similar to FIG. 2, showing a modification of structure.

Like reference numerals apply to similar parts throughout the several views, and in FIG. 1 the numeral 2 applies generally to a starter shingle embodying the present invention. It consists of a thin rectangular sheet (for example 3 feet by one foot) of composition material usually comprising layers of felt and bituminous material such as asphalt or tar, bonded together by heavy pressure, and having a layer 4 of chat or fine granules bonded into its entire upper surface by pressure, this being the surface a portion of which will be exposed to the weather. The chat provides better wear resistance, and also provides for a decorative appearance, since the chat is available in many different colors. For convenience, the edges of the shingle are designated with reference to its normal position when applied to a sloping roof deck 6, one of its longer edges being designated its upper edge 8, its opposite edge as its lower or butt edge 10, and its two shorter edges as its side edges 12. It is slotted upwardly from its butt edge 10, at right angles to said butt edge, to a distance less than one-half of its vertical height, at regular intervals across its width, the slots being indicated at 14. Also, "half" slots 16 are cut from the side edges 12 of the shingles, so that when the shingles are placed in edge-to-edge relation in the same course the two half slots of adjacent shingles form a single whole slot. Thus the butt edge portion of the shingle is divided into a series (three shown) of tabs 18 of equal width. In a so-called "seal down" shingle, a strip of heat-sensitive adhesive, usually in the form of a continuous series of short sections 20 forming a dashed line, is applied to the upper surface of the shingle, the line being parallel to the upper and lower edges thereof, extending the full width of the shingle, and spaced apart above the upper closed ends of slots 14. Usually, the slab of which the shingle is formed is thicker at its butt edge 10 than at its upper edge 8, producing what is known as a "thick-butt" shingle, but this is immaterial to the present invention.

The shingle as thus far described is conventional, and may be used in conjunction with the present starter shingle 2 as will appear. The conventional or standard shingles are designated by the numeral 22 in FIGS. 3–8. To adapt the shingle for use as a starter shingle, a line 24 is scored deeply in the under surface of the shingle, extending the full width of the shingle, parallel to its upper and lower edges, either at or closely adjacent the upper or closed ends of slots 14 (see FIGS. 1, 2 and 9). Preferably, the score line, the primary purpose of which is to permit easy breaking off of the shingle tabs 18, is disposed slightly below the extreme upper ends of slots 14, as shown, so that the slight notch remaining can serve as locaters for the proper positioning of the nails 26 used to secure the shingles in place. The preferred location of said nails is adjacent the upper end of each slot 14, and adjacent each side of the shingle at the same elevation, making a total of four nails. As a further locating device, a small horseshoe-shaped groove 28, opening toward the butt edge 10 of the shingle, may be pressed into the upper surface of the shingle in surrounding relation to each desired nail location. This nail location provides that each nail be disposed as far as possible from any adjoining nails of any overlying or underlying shingle, to defeat as far as possible any leakage of seepage water between the shingles through the nail holes in the shingles, and grooves 28 will tend to drain seepage water approaching the head of any nail downwardly around said nail rather than permitting said water to reach said nail to pass through the nail hole of the shingle. Alternatively to grooves 28, the shingle may be provided with a raised rib 30 (see FIG. 9), which it will be understood is also horseshoe-shaped and of the same general dimensions as grooves 28, surrounding each nail location. In this case, rib 30 is pressed into the lower surface of the shingles overlying it, and forms a dam effectively deflecting seepage water between the shingles from reaching the nails they encircle.

The use of the novel starter shingles, and their advantages as compared to present common practice, is illustrated in FIGS. 3–8. In common practice, as shown in FIG. 3, starter shingles are provided by a course of standard shingles 22, reversed end-for-end from the usual position of application, so their notches 14 open upwardly of the roof slope and their normally upper edges 8 are disposed downwardly of the slope. They are applied with their edges 8 flush with the eave edge of roof slab 6, and are affixed in place by nails 32, which may be disposed adjacent the eave edge as shown. Then a first course of standard shingles 22 is applied in their normal upright position, with their lower edges 10 also flush with the eave edge and edges 8 of the starter shingles, and secured by nails 34, and successive courses are added until the desired area of the roof is covered. Each course, after the first, is offset upwardly from the next lower course so that the lower edges 10 thereof are disposed at or near the upper or closed ends of slots 14. Also, the shingles of each course are offset laterally relative to those of the next lower course by such a distance that its slots 14 are disposed midway between the notches of the next lower course. This adds a decorative appearance to the finished roof, and also provides that the junctures between the side edges of the shingles in each course are disposed over unslotted portions of the shingles of the next lower course. As an aid in indexing the shingles properly in this respect, a pair of slits 36 may be formed in the upper edge portion 8 of each shingle, respectively spaced inwardly from the sides of the shingle by a distance equal to one-half of the width of one of the shingle butt tabs 18. The shingle material adjacent the appropriate slit 36 of a shingle in the lower course may be bent upwardly, and the side of a shingle being applied in the next higher course butted against the bent-up portion, acting as a stop, to provide the desired lateral indexing. Slits 36, however, are conventionally used, and are not pertinent to the present invention.

The above described conventional application is subject to certain disadvantages. The general portion of the roof is covered by two shingle layers, as described, with three layers in the areas in which the butt edge of each shingle overlies the upper edge portion of the shingles in the second lower course. However, when standard shingles are used as starter shingles, the upper edges of the starter shingles coincide with the upper shingle edges of the first normal course. This is wasteful of the shingle material, since an additional shingle layer is neither needed nor desirable in this area, and the additional layer must be penetrated by the nails securing the second normal course. Furthermore, the extra shingle thickness at the upper edges of the reversed standard shingles of the starter course opens a "dam space" 38 between the roof deck and the first normal course of shingles, as indicated in FIG. 7. Seepage water may be trapped and retained in this space, and may eventually find its way to, and through, the roof deck. Where three sets of shingles are added to the same roof deck, as also shown in FIG. 7, and as permitted by insurance regulations, this dam space is multiplied, and the chances of leakage correspondingly increased. Most importantly, perhaps, the use of reversed standard shingles as starter shingles results in the fact that their adhesive strips 20 cannot be positioned to seal down the tabs 18 of the first normal course of shingles, as is clearly shown in FIG. 3. Thus said tabs may be forced upwardly and peeled back by high winds, and this may successively permit the shingles of several higher courses to be peeled back.

In the use of the present starter shingles 2, the tabs 18 thereof are first broken off, this separation being facilitated and rendered quite accurate by the scored line 24 of the shingle. The remaining portions of the shingles are then secured along the eave edge of the roof deck by nails 40 as shown in FIG. 4. They are applied in their normal upright positions, not inverted or reversed, with their "broken" edge 42 flush with the eave edge. The nails 40 are normally placed relative to the shingle, at the same points they would be placed in a standard shingle. Successive courses of shingles are then applied normally as described above, with the lower edge of the first course flush with the broken edge 42 of the starter shingles, all as shown in FIG. 4. Thus, the present starter shingles eliminate the extra shingle thickness which occurred at the upper edge of the first normal course when reversed standard shingles were used as starters. This saves wastage of shingle material (the broken-off tabs 18 may be used later as will appear), and eliminates the enlarged "dam space" which previously occurred with the use of reversed standard shingles as starters, as indicated in FIGS. 4 and 8. Also, the present starter shingles have their adhesive strips 20 positioned to seal down the tabs 18 of the first normal shingle course, as particularly shown in FIG. 4. Thus all of the shingles, including the lowermost course, are "sealed down", which was not the case where reversed standard shingles were used for starters. Since the specially prepared starter shingles 2 are virtually identical with the standard shingles 22, except for the presence of scored lines 24 in the former, it would be theoretically possible to use shingles 2 to cover the entire roof, so long as they were all of the seal-down type. However, if it should happen that any tab 18 were not properly sealed down, it could easily be peeled back by wind, and break off at score line 24. Therefore, it is preferred that standard shingles, without the score line, be used in all courses excbpt the starter course, and that the special starter shingles 2 be handled separately from standard shingles, and clearly labelled as starter shingles.

The tabs 18 broken from the starter shingles as described above may be used in "topping out" the roof, as shown in FIGS. 5 and 6. When the topmost course of standard shingles is applied at each side of a roof ridge 44, the shingles at the opposite sides of the ridge may be spaced so far apart that standard ridge shingles 46, which are usually rectangular and bridge over the ridge, being overlapped longitudinally of the ridge and secured by nails 48, cannot overlap the upper edges of said normal courses to the proper degree. That is, said ridge shingles cannot cover the nails securing said top normal courses, nor reach to the upper ends of slots 14 thereof. Usually, this situation has required the use of another course of shingles above the top course of normal shingles, the lower edges of the added course having a normal relationship with the lower course, but having its top edge portion out away sufficiently that it does not cross ridge 44. The cut-away portions are normally discarded and wasted. In the present case, the tabs 18 which were previously broken away from shingles 2 to ready them for use as starter shingles, and which have been preserved, may be applied in normal relation to the highest course of full shingles 22, as shown in FIGS. 5 and 6, as a topping-out course, and secured by nails 50. Ridge shingles 46 will then overlap the tabs properly, covering nails 50. In FIG. 6, the lines 52 indicate generally the horizontal lines along which nails are applied. This use of tabs 18, rather than another course of cut-off full shingles, provides a substantial saving. If each bundle of shingles includes 27 shingles, as is common, and each shingle is three feet wide, the saving amounts to a full bundle of shingles for each 81 linear feet of ridge length, at each side of the ridge at which the tabs are used.

While I have shown and described a specific embodiment of my invention, it will be readily apparent that many minor modifications could be made without departing from the spirit of the invention.

What I claim as new and desire to protect by Letters Patent is:

1. A starter shingle comprising a generally rectangular sheet of shingle material having top, bottom and side edges, said sheet having a series of vertical slots formed therein at generally regular intervals across its width, said slots extending normally from said bottom edge to a height less than one-half of the distance between said top and bottom edges and dividing the lower edge portion of said shingle into a series of downwardly extending tabs, said sheet having a strip of heat-sensitive adhesive applied to the top surface thereof along a line parallel to the top and bottom shingle edges and adjacent but spaced above the closed upper ends of said slots, said shingle being deeply scored along a line parallel to the top and bottom edges thereof and generally at the closed upper ends of said slots, said shingle being easily and accurately breakable along said score line whereby to facilitate separation of said tabs from the remainder of the shingle to leave a starter shingle, a series of said starter shingles being adapted to be secured to a sloping roof deck in side-to-side abutting relation at the eave edge of said deck to form a starter course of shingles above which a series similarly slotted standard shingles may be applied in successively upwardly offset courses with the lower edge of the lowermost course of standard shingles also being flush with the eave edge of the roof deck, said starter course providing a continuous, unslotted shingle layer beneath the slotted edge portion of the first course of standard shingles to prevent leakage of water through said slots to said roof deck, the separated tabs being usable to simulate a final topping-out course of shingles adjacent a ridge of the roof.

2. A starter shingle as recited in claim 1 wherein said score line is formed in the bottom surface thereof, which will engage the roof deck, in order to avoid damage to any scoring tool used by the hard, abrasive granules with which the upper surface thereof is commonly faced.

* * * * *